US009159468B2

(12) United States Patent
Kebbabi et al.

(10) Patent No.: US 9,159,468 B2
(45) Date of Patent: Oct. 13, 2015

(54) HIGH-VOLTAGE ELECTRICAL TRANSMISSION CABLE

(71) Applicant: NEXANS, Paris (FR)

(72) Inventors: Lazhar Kebbabi, Lyons (FR); Sophie Barbeau, Genas (FR)

(73) Assignee: NEXANS, Paris (FR)

( * ) Notice: Subject to any disclaimer, the term of this patent is extended or adjusted under 35 U.S.C. 154(b) by 64 days.

(21) Appl. No.: 13/893,624

(22) Filed: May 14, 2013

(65) Prior Publication Data

US 2013/0306349 A1 Nov. 21, 2013

(30) Foreign Application Priority Data

May 16, 2012 (FR) ..... 12 54504

(51) Int. Cl.

| | |
|---|---|
| ***H01B 7/00*** | (2006.01) |
| *B05D 3/02* | (2006.01) |
| *H01B 5/00* | (2006.01) |
| *H01B 5/10* | (2006.01) |

(52) U.S. Cl.

CPC ..... *H01B 7/00* (2013.01); *H01B 5/107* (2013.01); *H01B 5/004* (2013.01); *H01B 5/105* (2013.01)

(58) Field of Classification Search

CPC ..... H01B 7/18
USPC ..... 174/126.1, 28, 107
See application file for complete search history.

(56) References Cited

U.S. PATENT DOCUMENTS

| | | | | |
|---|---|---|---|---|
| 3,309,455 | A * | 3/1967 | Mildner | 174/29 |
| 3,717,720 | A * | 2/1973 | Snellman | 174/131 A |
| 4,175,212 | A * | 11/1979 | Artbauer | 174/128.1 |
| 4,200,126 | A * | 4/1980 | Fish | 138/143 |
| 4,687,882 | A * | 8/1987 | Stone et al. | 174/102 SC |
| 5,068,497 | A * | 11/1991 | Krieger | 174/106 R |
| 5,243,137 | A * | 9/1993 | Gentry | 174/128.1 |
| 5,298,682 | A * | 3/1994 | Salz | 174/105 R |
| 5,500,488 | A * | 3/1996 | Buckel | 174/102 R |
| 6,395,975 | B1 * | 5/2002 | Bosisio et al. | 174/25 R |
| 7,060,326 | B2 * | 6/2006 | Hiel et al. | 427/384 |
| 2002/0053446 | A1 * | 5/2002 | Moe et al. | 174/21 C |
| 2005/0199414 | A1 * | 9/2005 | Kim et al. | 174/110 R |
| 2007/0128435 | A1 * | 6/2007 | Hiel et al. | 428/375 |

FOREIGN PATENT DOCUMENTS

| | | |
|---|---|---|
| DE | 542848 | 1/1932 |
| DE | 4212147 | 10/1993 |
| EP | 1220235 | 7/2002 |
| GB | 429977 | 6/1935 |
| GB | 2029043 | 3/1980 |

OTHER PUBLICATIONS

International Search Report dated Jan. 11, 2013.

* cited by examiner

*Primary Examiner* — Timothy Thompson
*Assistant Examiner* — Michael F McAllister
(74) *Attorney, Agent, or Firm* — Sofer & Haroun, LLP

(57) ABSTRACT

An electrical cable (10) includes at least one central reinforcing element (1, 2) extending along the cable, said reinforcing element being encircled by at least one electrically conductive element (3) extending along the cable, where the central reinforcing element (1, 2) is a tubular body.

16 Claims, 1 Drawing Sheet

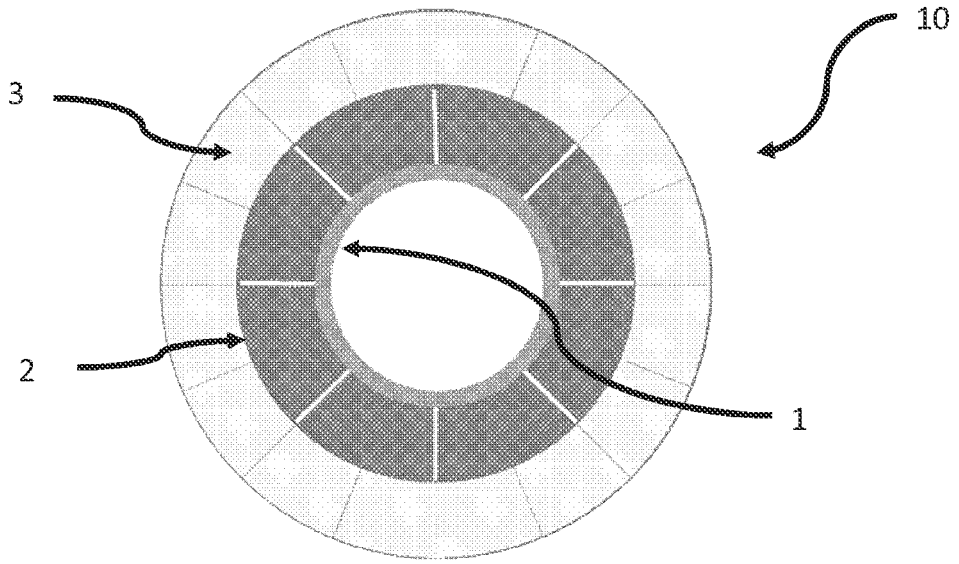
10
3
2
1

HIGH-VOLTAGE ELECTRICAL TRANSMISSION CABLE

RELATED APPLICATION

This application claims the benefit of priority from French Patent Application No. 12 54504, filed on May 16, 2012, the entirety of which is incorporated by reference.

BACKGROUND

1. Fields of the Invention

The present invention relates to an electrical cable. It is typically, but not exclusively, employed as a high-voltage electrical transmission cable or overhead cable, commonly called an overhead line (OHL), to transmit power.

More particularly, the invention relates to an electrical cable that reduces the incidence of the corona effect.

2. Description of the Related Art

Overhead lines are traditionally formed by bare conductive elements held by an appropriate array of pylons. These lines are conventionally intended to transmit high-voltage (225 to 800 kV) AC electrical power. Each conductor therefore has a diameter of a few centimeters and may be composed of a metal layer or, more frequently, of several assembled metal wires. Along the bare conductor an effect, called the corona effect, is always observed. Specifically, any conductor or line subjected to a high voltage will exhibit the corona effect. Once the electric field at the surface of the conductor, especially depending on local radii of curvature, becomes sufficiently high locally (i.e. higher than the dielectric strength of moist air, about 10 kV/cm; or even higher than the dielectric strength of dry air, about 30 kV/cm), the air ionizes and a luminous corona forms around the conductor.

One of the consequences of the corona effect is the production of noise. However, when the conductor is dry a very limited amount of noise is generated, which is practically negligible in terms of the discomfort it causes. In contrast, when the conductor is wet the noise generated is much louder and it is a source of notable discomfort and a great deal of annoyance for people passing by or living next to this type of conductor. Specifically, under these conditions, the conductivity of the air increases and thus the ionization is more intense and more efficient.

The corona effect also results in power losses and the electromagnetic radiation, acoustic noise, and power losses generated may have health effects.

In order to overcome this problem, one solution consists in insulating the conductors by covering them with a layer of an insulating plastic material, so as to prevent electrical contact between the biased metal parts and the air, thereby suppressing the corona effect.

In another approach, it has been suggested to increase the diameter of the cable. Document DE 4 424 007 describes an electrical cable especially comprising at least one layer of a conductive element intended to conduct the power transmitted by the cable in its operational configuration, and a supporting element formed from carbon fibers. Said supporting element encircles said layer of the conductive element or is positioned between two layers of said conductive element, which layers are intended to conduct the power transmitted by the cable in its operational configuration. Increasing the diameter of the cable reduces the tangential electric field and therefore the incidence of the corona effect. However, this type of cable has the drawback of either being too heavy or not adequately reducing the incidence of the corona effect. Furthermore, its current capacity is limited.

OBJECTS AND SUMMARY

The aim of the invention is to overcome the aforementioned drawbacks, i.e. to suppress or at least to considerably reduce the corona effect while increasing current capacity.

For this purpose, the subject of the invention is an electrical cable comprising at least one central reinforcing element extending along the cable, said reinforcing element being encircled by at least one electrically conductive element extending along the cable, characterized in that said central reinforcing element is a tubular body. Preferably, said central reinforcing element makes direct physical contact with said electrically conductive element.

Specifically, the Applicant has observed that a cable with features according to the invention surprisingly reduces the incidence of the corona effect while increasing current capacity.

Specifically, relative to conventional OHL cables, the cable according to the invention has a larger diameter but the same weight. The presence of the tubular body increases the apparent diameter of the cable while only increasing the weight of the cable by a small amount.

Therefore, in its operational configuration, the electric field at the surface of the cable is relatively low, especially about 0.5 kV/mm, thus allowing the incidence of the corona effect, which appears for electric field strengths of 3 kV/mm or more, to be reduced.

Furthermore, given that the electrically conductive element lies on the entire external surface of the cable, heat exchange with the surrounding air is higher relative to prior art cables comprising a covering that at least partially encircles the electrically conductive element, or relative to prior art cables the conductive element of which does not lie on the surface. Thus, the conductive element is more rapidly cooled and thus, for a given size, a larger amount of current can be transmitted by said element.

In the present invention, the term "central" is understood to mean that the reinforcing element has the most central position in the electrical cable, in cross section. Preferably, the reinforcing element and the electrically conductive element (s) are placed coaxially.

In contrast to the electrically conductive element of the electrical cable, the tubular body according to the invention is not intended to transmit power, and its only function is to support the electrically conductive element(s), while reinforcing the electrical cable.

The expression "tubular body" is understood to mean a tube-shaped element having a ring-shaped cross section, the thickness of which is substantially constant along the length of the tubular body.

The interior of this tube is in particular empty i.e. free of any element. The centre of the electrical cable thus comprises a longitudinal orifice.

This tubular body advantageously makes it possible to improve the mechanical strength characteristics of the electrical cable by uniformly distributing the mechanical forces that may be caused especially by compression of the electrically conductive elements during installation of the OHL-type electrical cable.

Specifically, to suspend this type of electrical cable from an electricity pylon, anchoring accessories are necessary. These accessories serve for mechanically connecting the electrical cable to an electricity pylon on which it has to be installed. Likewise, to connect two lengths of electrical cable according to the invention, jointing accessories are used. These accessories are put into position by being compressed onto the conductive element(s).

The tubular body may have an inside diameter (i.e. the diameter of the longitudinal orifice) of about 5 to 80 mm, and preferably of 10 to 30 mm.

According to a first embodiment, the tubular body may comprise a layer of a metallic material, or in other words a first layer (i.e. first reinforcing layer) of a metallic material.

This metallic material may be chosen from steel, steel alloys, aluminum, aluminum alloys, copper, and copper alloys, or one of their combinations.

Aluminum or aluminum alloys will preferably be used for said first layer because they are lighter (especially relative to steel).

The external surface of the first layer may be smooth or corrugated.

The first layer may be at most 3 mm in thickness, preferably at most 2 mm in thickness, and is particularly preferably between 0.3 and 0.8 mm in thickness.

The weight per unit length of the first layer may range from 0.05 to 0.2 kg/m, and preferably is about 0.1 kg/m.

According to a second embodiment, the tubular body may comprise a layer of a nonmetallic material, or in other words a second layer (i.e. second reinforcing layer) of a nonmetallic material.

This nonmetallic material may be chosen from fibers (preferably continuous fibers), nanofibers, and nanotubes, or one of their mixtures.

By way of example, the fibers (which are preferably continuous fibers) may be chosen from fibers made of carbon, glass, aramids (Kevlar), ceramics, titanium, tungsten, graphite, boron, poly(p-phenylene-2,6-benzobisoxazole) (Zylon), basalt, and alumina, or one of their combinations.

Preferably, the nanofibers may be carbon nanofibers.

Preferably, the nanotubes may be carbon nanotubes.

In one particular embodiment, the material of the second layer may be at least partially embedded in an organic matrix. Said organic matrix may for example be a thermoplastic and/or thermosetting matrix. A thermosetting matrix will preferably be used especially one chosen from the epoxy resins, vinyl ester resins, polyimide resins, polyester resins, cyanate ester resins, phenolic resins, bismaleimide resins, and polyurethane resins, or one of their mixtures.

The thickness of said second layer may range from 5 to 50 mm, and its weight per unit length may range from 0.05 to 0.5 kg/m.

Moreover, this second layer preferably has a trapezoidal-shaped or "Z"-shaped cross section.

According to a third embodiment, the tubular body may comprise said first layer and said second layer.

In one particular variant of this third embodiment, the second layer advantageously encircles the first layer. Preferably, the first layer makes direct physical contact with the second layer.

Regarding the electrically conductive element of the invention, it is intended to transmit power (i.e. for high-voltage electrical transmission).

It may preferably be metallic, especially based on aluminum, namely either made entirely of aluminum or of an aluminum alloy such as for example an aluminum/zirconium alloy.

Aluminum and aluminum alloys have the advantage of having a significantly optimized electrical conductivity/specific weight combination, especially relative to copper.

The electrically conductive element of the invention may be a conventional assembly of metal wires (or strands) the cross sections of which may be circular or noncircular, or a combination of both. When they are noncircular, the cross section of these wires may for example be trapezoidal or "Z"-shaped. Various types of shape are defined in standard IEC 62219.

The electrical cable according to the invention may have an apparent diameter (i.e. outside diameter) possibly ranging from 10 to 100 mm.

Preferably, the electrical cable of the invention does not comprise an external layer encircling the electrically conductive element(s).

Thus, the electrically conductive element(s) make direct contact with their external environment (e.g. the ambient air). This absence of an external layer around the conductive element(s) has the advantage of guaranteeing that such an electrical cable has the lowest possible installation tension, this installation tension being proportional to the weight of the electrical cable. In other words, it is beneficial to have an OHL electrical cable presenting the lowest possible mechanical load, this mechanical load being exerted by the cable on the two pylons between which it is suspended. Consequently, the span of the electrical cable between two electricity pylons may be up to 500 m, or even up to 2000 m.

The electrical cable of the invention may more particularly be a high-voltage electrical transmission cable, especially a high-voltage overhead line (OHL) carrying an AC voltage of at least 225 kV and possibly an AC voltage of as high as 800 kV. This type of cable is generally held between two pylons.

BRIEF DESCRIPTION OF THE DRAWINGS

To enable better comprehension of the invention it will now be described with reference to the appended drawing, which is provided merely by way of nonlimiting illustration.

In the drawing, FIG. 1 is a schematic cross-sectional view of a cable according to the present invention.

DETAILED DESCRIPTION

For the sake of clarity, only elements that are essential for the invention to be understood have been illustrated, the illustration being schematic and not to scale.

The electrical cable 10, illustrated in FIG. 1, corresponds to a high-voltage electrical transmission line of the OHL type.

This cable 10 comprises a central tubular body comprising:

a first reinforcing layer 1, which is not intended to conduct power; and a second reinforcing layer 2, the first layer 1 being encircled by the second layer 2.

Said electrical cable 10 furthermore comprises an electrically conductive element 3, intended to transmit electrical power, encircling the second reinforcing layer 2.

The electrically conductive element 3 makes direct physical contact with the second reinforcing layer 2, the second layer 2 itself making direct physical contact with the first reinforcing layer 1.

The first reinforcing layer 1 may be obtained from a metal strip shaped into a tube with a longitudinal slit using a forming tool. Next, the longitudinal slit is welded, especially using a laser welding device or a gas-shielded arc welding device, after the edges of said strip have been brought into contact with each other and held in place in order to be welded. The diameter of the tube formed may then be shrunk (decrease in the cross section of the tube) using techniques that are well, known to those skilled in the art.

The second reinforcing layer 2 comprises a plurality of carbon fiber strands coated with a thermosetting matrix made of epoxy resin, these strands having trapezoidal-shaped cross sections.

The electrically conductive element 3 is, in this example, an assembly of strands made of an aluminum/zirconium alloy, each strand having a trapezoidal-shaped cross section, these strands being twisted together. Said electrically conductive element is therefore not in any way sealed from its external environment, and its constituent strands moreover move apart under the effect of heating, due to thermal expansion of the conductive element.

Furthermore, the cable in FIG. 1 does not comprise an external sheath. The electrically conductive element 3 thus makes direct contact with its external environment (i.e. the ambient air). In the operational configuration of the electrical cable, once the cable has been suspended between two electricity pylons, the absence of an external sheath advantageously allows the length of said cable suspended between two electricity pylons to be increased and better cooling of the cable to be obtained.

Although the invention was described with regard to a particular embodiment, it is clearly obvious that it is in no way limited thereto and that it comprises any technical equivalent of the means described and their combinations if the latter are covered by the scope of the invention.

The invention claimed is:

1. High voltage electrical transmission cable comprising:

at least one central reinforcing element extending along the cable, said reinforcing element being encircled by at least one electrically conductive element extending along the cable, said electrically conductive element formed as an assembly of strands, each strand having a cross section with a trapezoidal or "Z" shape being intended to transmit power for high voltage transmission, wherein said central reinforcing element is a tubular body comprising at least one layer of a nonmetallic material, and at least one layer of a metallic material the metallic material being the innermost layer of said nonmetallic tubular body while maintaining a hollow central core of said tubular body.

2. Cable according to claim 1, wherein the metallic material is selected from the group consisting of steel, steel alloys, aluminum, aluminum alloys, copper, and copper alloys, and one of their combinations.

3. Cable according to claim 1, wherein the external surface of the layer of a metallic material is either smooth or corrugated.

4. Cable according to claim 1, wherein the nonmetallic material is selected from the group consisting of fibers, nanofibers, and nanotubes, and one of their mixtures.

5. Cable according to claim 4, wherein the fibers are selected from the group consisting of fibers made of carbon, glass, aramids, ceramics, titanium, tungsten, graphite, boron, poly(p-phenylene-2,6-benzobisoxazole), basalt, and alumina, and one of their combinations.

6. Cable according to claim 4, wherein the nanofibers are carbon nanofibers.

7. Cable according to claim 4, wherein the nanotubes are carbon nanotubes.

8. Cable according to claim 1, wherein the material of the layer of a nonmetallic material is at least partially embedded in an organic matrix.

9. Cable according to claim 1, wherein the layer of a nonmetallic material encircles the layer of a metallic material.

10. Cable according to claim 1, wherein the electrically conductive element is based on aluminum.

11. Cable according to claim 1, wherein the electrical cable does not comprise an external layer encircling the electrically conductive element(s).

12. Cable according to claim 1, wherein said cable is a high voltage overhead line (OHL) cable.

13. Cable according to claim 1, wherein the center of the electrical cable comprises a longitudinal orifice having an inside diameter of about 5 to 80 mm.

14. High voltage electrical transmission cable comprising:

at least one central reinforcing element extending along the cable, said reinforcing element being encircled by at least one electrically conductive element extending along the cable, said electrically conductive element being intended to transmit power for high voltage transmission, wherein said central reinforcing element is a tubular body comprising at least one layer of a nonmetallic material, and wherein the center of the electrical cable comprises a longitudinal orifice having an inside diameter of about 5 to 80 mm.

15. High voltage electrical transmission cable comprising:

at least one central reinforcing element extending along the cable, said reinforcing element being encircled by at least one electrically conductive element extending along the cable, said electrically conductive element being intended to transmit power for high voltage transmission, wherein said central reinforcing element is a tubular body comprising at least one layer of a nonmetallic material, and wherein the thickness of said nonmetallic layer ranges from 5 to 50 mm.

16. High voltage electrical transmission cable comprising:

at least one central reinforcing element extending along the cable, said reinforcing element being encircled by at least one electrically conductive element extending along the cable, said electrically conductive element being intended to transmit power for high voltage transmission, wherein said central reinforcing element is a tubular body comprising at least one layer of a nonmetallic material, and wherein the weight per unit length of said nonmetallic layer range from 0.05 to 0.5 kg/m.

* * * * *